US011548775B2

(12) United States Patent
Lopez et al.

(10) Patent No.: US 11,548,775 B2
(45) Date of Patent: Jan. 10, 2023

(54) PROTECTIVE CAP FOR BEVERAGE DISPENSING SPIGOT

(71) Applicants: Saul Lopez, Houston, TX (US); Reginaldo Lopez, Houston, TX (US); Erik Lopez, Houston, TX (US)

(72) Inventors: Saul Lopez, Houston, TX (US); Reginaldo Lopez, Houston, TX (US); Erik Lopez, Houston, TX (US)

( * ) Notice: Subject to any disclaimer, the term of this patent is extended or adjusted under 35 U.S.C. 154(b) by 0 days.

(21) Appl. No.: 17/650,392

(22) Filed: Feb. 9, 2022

(65) Prior Publication Data

US 2022/0268394 A1 Aug. 25, 2022

Related U.S. Application Data

(60) Provisional application No. 63/148,616, filed on Feb. 12, 2021.

(51) Int. Cl.

| | |
|---|---|
| ***B67D 1/08*** | (2006.01) |
| ***B67D 3/00*** | (2006.01) |
| ***B65D 55/16*** | (2006.01) |

(52) U.S. Cl.

CPC ..... *B67D 1/0887* (2013.01); *B65D 55/16* (2013.01); *B67D 3/0058* (2013.01)

(58) Field of Classification Search

CPC ..... B67D 1/0887; B65D 55/16
USPC ..... 220/212.5, 375, 710.5; 215/306; 222/571

See application file for complete search history.

(56) References Cited

U.S. PATENT DOCUMENTS

| | | | | | |
|---|---|---|---|---|---|
| 1,633,197 | A * | 6/1927 | Snyder | B65D 35/42 | 220/291 |
| 1,924,242 | A * | 8/1933 | Kaye | B65D 55/16 | 222/542 |
| 1,937,674 | A * | 12/1933 | Teason | B65D 35/42 | 220/291 |
| 1,956,500 | A * | 4/1934 | Fearebay | B65D 35/42 | 220/375 |
| 2,581,849 | A * | 1/1952 | Fisch | B65D 35/42 | 220/288 |
| 2,599,472 | A * | 6/1952 | Miller | F16N 21/06 | 184/105.3 |
| D185,179 | S * | 5/1959 | Tupper | D9/446 | |
| 3,145,872 | A * | 8/1964 | Hayes | B65D 55/16 | 220/375 |
| 3,147,824 | A * | 9/1964 | Henderson | F16N 21/06 | 215/244 |
| 3,181,725 | A * | 5/1965 | Friedl | B65D 39/08 | 220/293 |
| 3,214,881 | A * | 11/1965 | Hayes | B65D 55/16 | 220/837 |

(Continued)

*Primary Examiner* — Frederick C Nicolas
*Assistant Examiner* — Randall A Gruby
(74) *Attorney, Agent, or Firm* — Tatonetti IP

(57) ABSTRACT

A protective cap for a container's spigot is configured with a looped section and a cap. The looped section may have one or more loops to secure and hang around a spigot's neck for convenient use. The looped section may have an upper loop distal from the cap and a lower loop proximal to the cap, in which the lower loop has a relatively smaller diameter than the upper loop. A bottom of the looped section may have an incline that provides additional support to the looped section. The cap includes an opening that leads to a bottom surface that covers the outlet along with the cap's sidewalls and enhances cleanliness.

5 Claims, 8 Drawing Sheets

(56) References Cited

U.S. PATENT DOCUMENTS 3,247,998 A * 4/1966 Tantlinger ..... B60T 17/046 220/834
D228,887 S * 10/1973 Gedell ..... D9/446
3,860,135 A * 1/1975 Yung ..... B65D 50/069 220/375
3,874,570 A * 4/1975 Katzman ..... B65D 35/42 220/288
3,918,616 A * 11/1975 Goldsmith ..... B67D 3/02 D7/398
4,060,100 A * 11/1977 Miller ..... F16L 55/11 D8/499
4,213,546 A * 7/1980 Massey ..... B65D 55/16 222/326
4,728,037 A * 3/1988 Mainhardt ..... B05B 11/04 224/601
5,044,512 A * 9/1991 Giancaspro ..... A47G 19/2272 220/759
5,725,121 A * 3/1998 Gianpaolo ..... B65D 5/746 220/784
D411,106 S * 6/1999 Conrad ..... D9/446
6,196,254 B1 * 3/2001 Shaw ..... B60C 29/06 137/231
6,478,180 B1 * 11/2002 Dehn, Sr. ..... B65D 51/18 215/276
6,814,639 B1 * 11/2004 Peterson ..... F16K 15/205 441/41
7,946,444 B2 * 5/2011 Counts-Bradley .... F16L 55/115 138/92
8,544,695 B2 * 10/2013 Gordon ..... B65D 23/001 248/220.21
8,783,487 B2 * 7/2014 Hojo ..... B65D 1/40 215/396
D741,176 S * 10/2015 Bell ..... D9/446
D753,998 S * 4/2016 Murphey ..... D9/446
D797,555 S * 9/2017 Carlson ..... D9/446
D809,060 S * 1/2018 Zhang ..... D19/194
D839,730 S * 2/2019 Wang ..... D9/446
10,661,945 B2 * 5/2020 Beardsell ..... B65D 23/04
2004/0164079 A1 * 8/2004 Alois ..... B65D 39/0005 220/375
2004/0206721 A1 * 10/2004 Swanberg ..... B65D 55/16 215/306
2005/0167432 A1 * 8/2005 Gerdes ..... B60K 15/0406 220/375
2005/0247714 A1 * 11/2005 Backes ..... B65D 47/148 215/235
2009/0255962 A1 * 10/2009 Dressel ..... B65D 47/0828 222/562
2017/0121084 A1 * 5/2017 Moorehouse ..... B65D 35/44
2019/0185233 A1 * 6/2019 Wang ..... B65D 41/34
2022/0250816 A1 * 8/2022 Tamarindo ..... B65D 55/16

* cited by examiner

PROTECTIVE CAP FOR BEVERAGE DISPENSING SPIGOT

CROSS-REFERENCE TO RELATED APPLICATIONS

This non-provisional utility patent application claims the benefit of and priority to U.S. Provisional Patent Application Ser. No. 63/148,616 filed Feb. 12, 2021, entitled "Protective Cap for Beverage Dispensing Spigot," the entire contents of which are hereby incorporated herein by reference.

BACKGROUND

Beverage coolers, reservoirs, and other containers (individually and collectively referred to herein as "containers") typically have a spigot from which beverages are dispensed. These containers are often transported and may be used at parties or large gatherings, among other scenarios, exposing the container's spigot to external elements that may include bacteria, germs, and pests. This may detract people from using these convenient and cost-effective containers for individualized bottles or cans.

SUMMARY

A protective cap for a container's spigot is configured with a looped section and a cap. The looped section may have one or more loops to secure and hang around a spigot's neck for convenient use. The looped section may have an upper loop distal from the cap and a lower loop proximal to the cap, in which the lower loop has a relatively smaller diameter than the upper loop. The lower loop can be adapted to have a press- or snap-fit size to the spigot so that, when the container is tilted, it stays out of the way as the beverage is poured. A bottom of the looped section may have an incline that provides additional support to the looped section. The incline may begin at or substantially at the beginning of the lower loop. The additional support from the incline may, for example, prolong the life of the protective cap since the looped section may stretch so the cap can reach a spigot's outlet. The cap includes an opening that leads to a bottom surface that covers the outlet along with the cap's sidewalls and enhances cleanliness. The caps interior opening may gradually decrease in diameter toward the bottom surface, which helps provide a press-fit mechanism against varying sized outlets. While the protective cap may be comprised of silicone or other elastic rubber material to facilitate the stretching of the device, other materials may also be used. For example, one or more components may be comprised of a plastic or metal material. If the cap that secures to an outlet is made out of a material other than rubber or silicone, then the inside opening may be coated with a silicone or rubber material to enable the press-fit functionality.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 3:
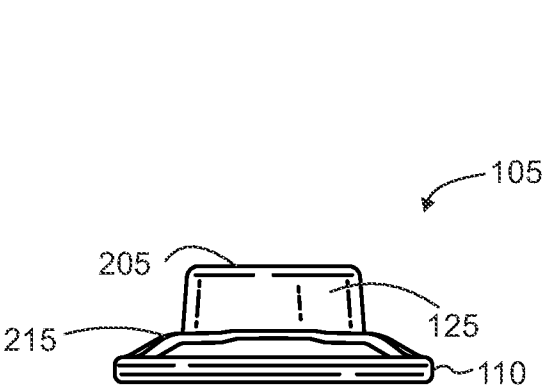
FIGS. 1-3 show illustrative representations of a protective cap from various angles.
Figure 2:
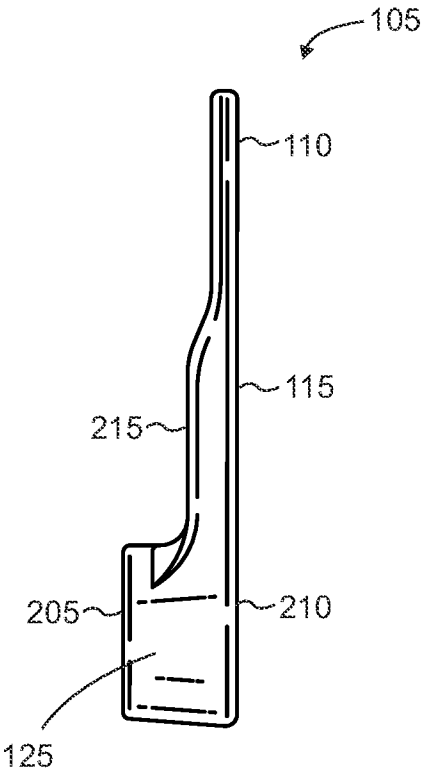
Figure 1:
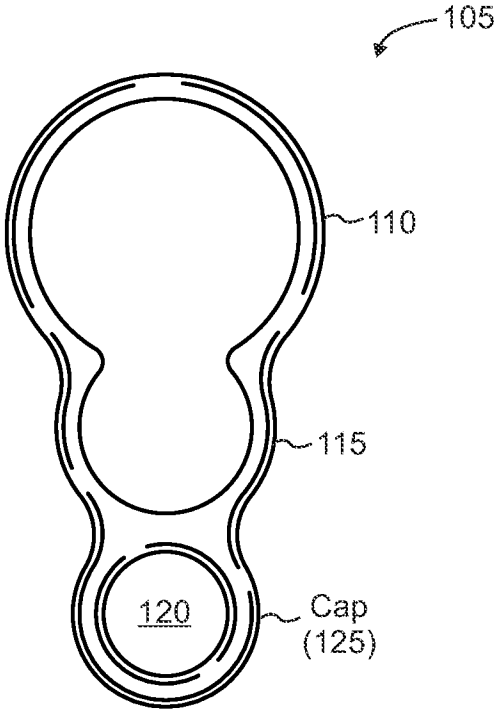

FIGS. 1-3 show illustrative representations of a protective cap 105, which includes a looped section to secure to a spigot and a cap 125 that secures to the spigot's outlet. In typical implementations, the protective cap may be comprised of silicon, but other materials may also be used, such as plastic, metal, rubber, or another elastic material. The components of the protective cap may be comprised of all the same material or utilize different materials. For example, the looped section may be comprised of one material, and the cap 125 may be comprised of a different material. If plastic or metal is used, the inside of the cap 125 may have some silicone or rubber material to facilitate the press-fit functionality, as discussed in greater detail below. If silicone rubber is used, it may have a durometer of 55 on the Shore A Hardness Scale, but other variations may occur based on the specific implementation.

The looped section includes an upper loop 110 and a lower loop 115 relatively smaller in diameter than the upper loop. This lower loop may also help adjust the protective cap's positioning when secured to the spigot. While the center of the looped section is hollow, cap 125 has an interior bottom surface 120, which covers the spigot's outlet to enhance cleanliness and prevent the outlet from being exposed to pests, hosting bacteria, germs, and the like.

FIG. 2 shows an illustrative representation in which the bottom of the looped section has a gradual incline 215 toward the cap 125. The incline may increase the support of that area of the protective cap 105 relative to the upper loop 110. The incline is positioned substantially at the lower loop 115. As discussed in greater detail below, cap 125 includes an opening 210 (not shown) and a bottom 205. The bottom is where the interior bottom surface 120 is, as shown in FIG. 1. FIG. 3 shows another angle of the looped section and the incline 215.

Figure 4:
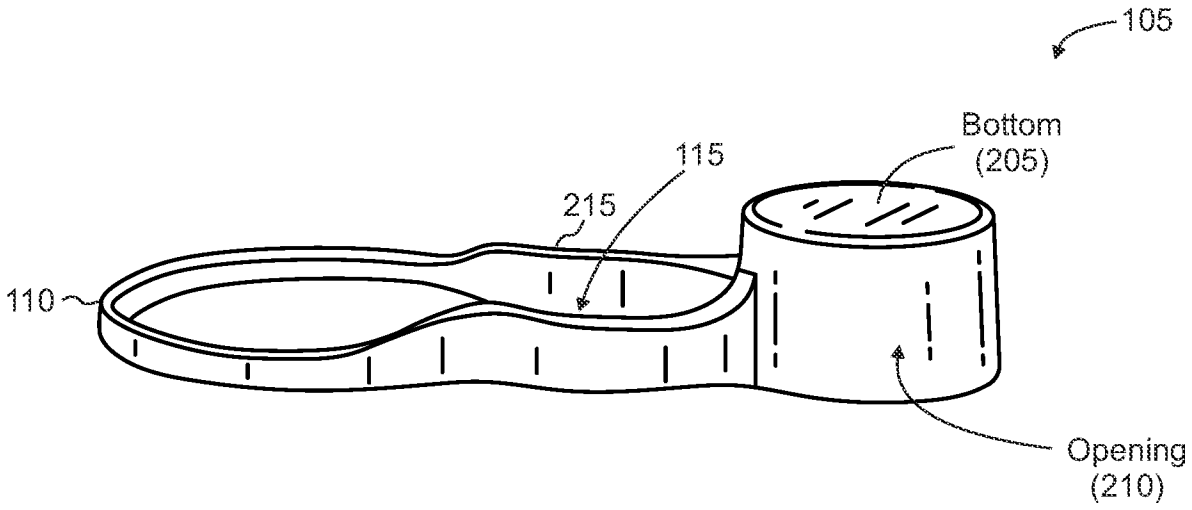
FIG. 4 shows an illustrative representation of the bottom of the protective cap.

FIG. 4 shows an illustrative representation of the protective cap 105 from a bottom angle in which the incline 215 is more readily shown. As the upper loop 110 transitions into the lower loop 115, the incline becomes present. The lower loop is thicker than the upper loop, so it can function as a snap-fit against the spigot stem when the container is tilted, which is typically done to pour out the remaining beverage from the container. Furthermore, the incline gradually increases when the looped section connects to cap 125. The opening 210 is used to go over and secure to a spigot's outlet to protect it from germs and bacteria, and the bottom 205 covers the outlet itself. The surrounding walls and the bottom collectively protect the outlet when in position.

Figure 5:
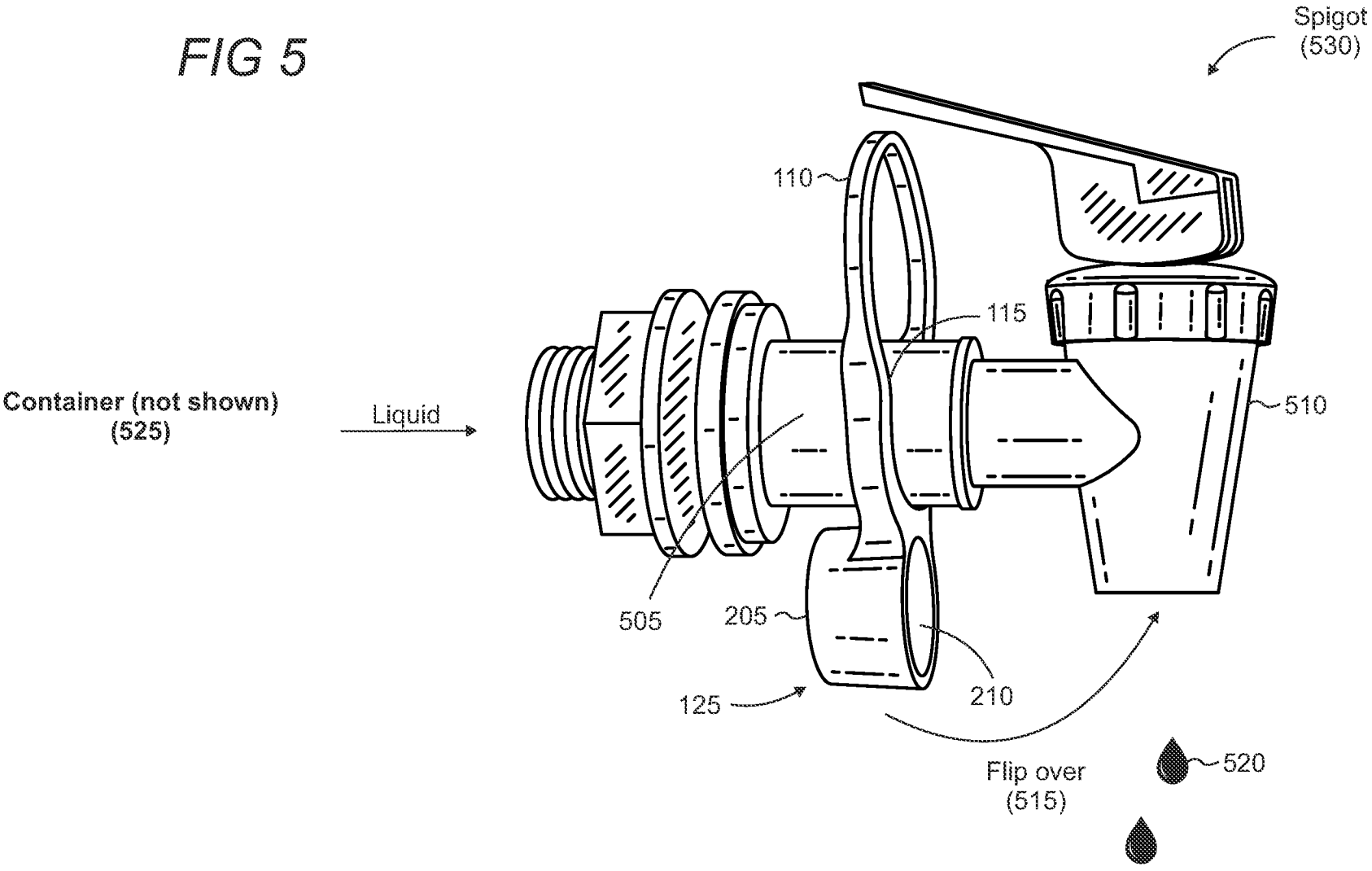
FIG. 5 shows an illustrative representation of the protective cap's lower loop secured to a spout's neck.

FIG. 5 shows an illustrative representation in which the protective cap 105 is secured over a stem 505 of a spigot 530. The spigot may be connected to a container 525 (not shown), from which liquid is dispensed and poured from the spigot's outlet 510. In this example, the lower loop 115 is secured to the stem. Should the lower loop fall for some reason, the upper loop would rest against the stem. Drops 520 are for illustrative purposes only to show that the spigot can operate while the protective cap is in place but not yet in use. As shown, the user can flip over 515 the cap 125 so that its opening 210 secures to the spigot's outlet 510.

Figure 6:
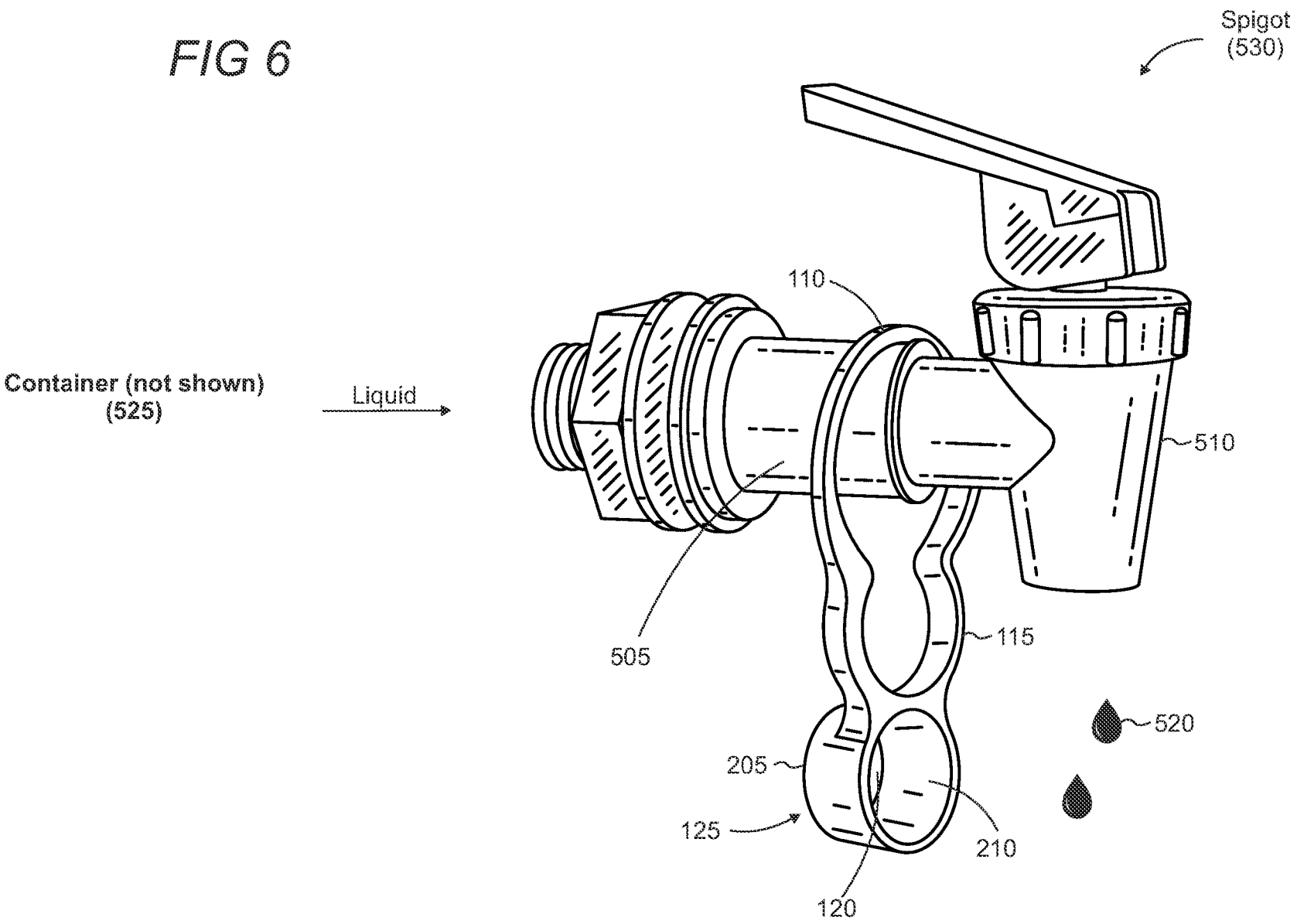
FIG. 6 shows an illustrative representation of the protective cap's upper loop secured to the spout's neck.

FIG. 6 shows an illustrative representation in which the protective cap 105 is secured to the stem 505 at the upper loop. The multiple loops may be used to accommodate differently sized and lengthed spigots. For example, the distance between the stem 505 and outlet 510 may vary by spigot design. Likewise, the width of the stem may vary, which may influence whether the user will use the lower loop 115 or upper loop 110. The double loop design may serve at least two purposes: 1) the upper loop can accommodate most sized spigot stems, while the lower loop can clip (press-fit) onto most standard sized spigot stems to thereby prevent the protective cap from interfering with the dispensed beverage when the user tilts the container.

Figure 7:
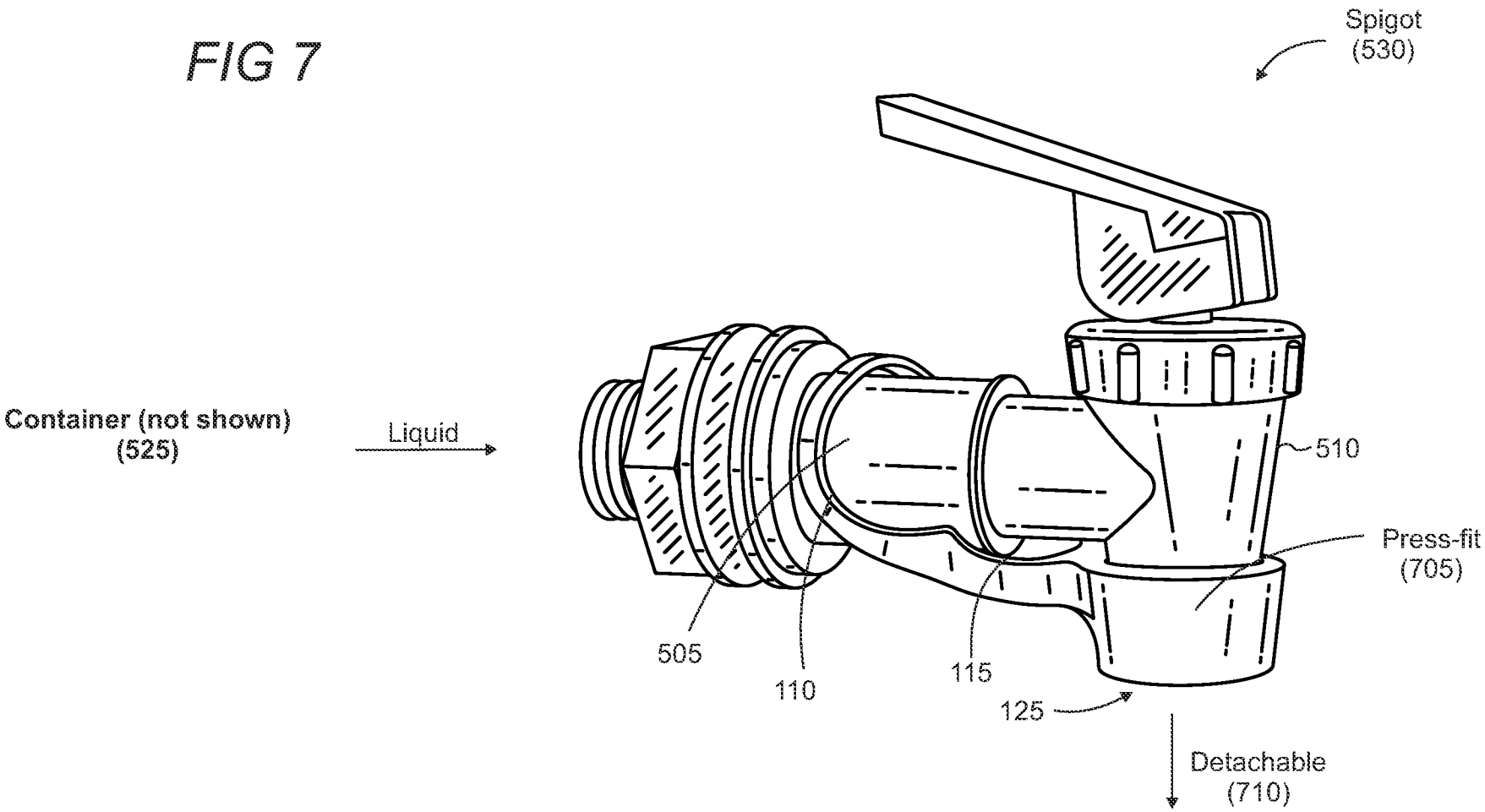
FIG. 7 shows an illustrative representation of the cap secured to the outlet.
Figure 8:
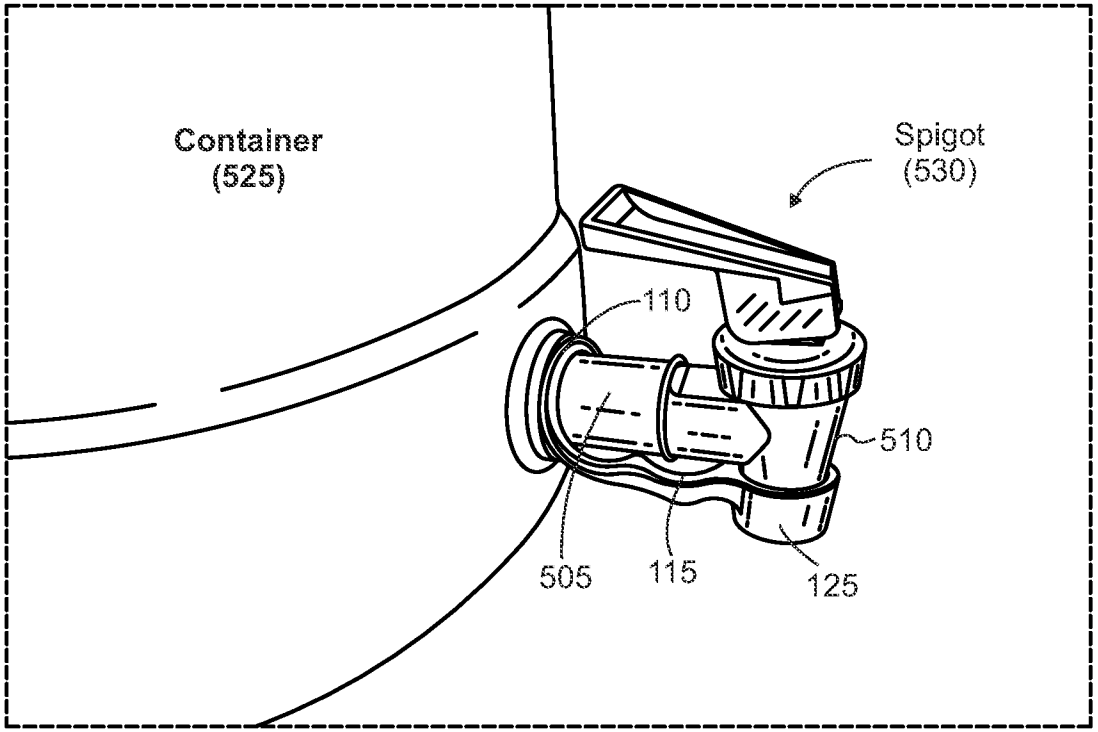
FIG. 8 shows an illustrative representation of the cap secured to the spigot from another angle.

FIGS. 7 and 8 show illustrative representations in which the cap 125 is secured to outlet 510. As shown, the looped section, which includes upper loop 110 and lower loop 115, may stretch so that the cap 125 can secure to the outlet. The cap's opening 210 may be configured as a press-fit mechanism that secures to the outlet. The opening diameter of the opening 210, for example, may gradually decrease to facilitate the press-fit functionality. This may also help accommodate differently sized outlets. The cap is still detachable 710 from the outlet when a user wishes to dispense some beverage. The user can pull the looped section upwards so that the lower loop is secured to the stem (FIG. 5), preventing the cap 125 from interfering with the dispensed liquid into the user's cup. FIG. 8 further shows the configuration of the spigot 530, container 525, and protective cap 125 relative to each other when in use.

Figure 9:
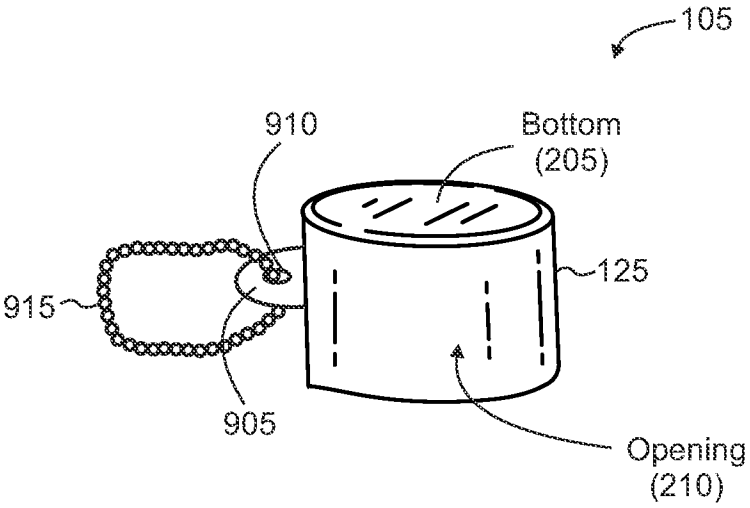
FIG. 9 shows an illustrative representation of the protective cap with a chain.

FIG. 9 shows an illustrative representation of the protective cap 105 according to another embodiment in which the looped section is comprised of a chain 915. The chain is secured inside a hole 915 on an extension 905 from cap 125. This implementation may function similarly to the protective cap described above, only the looped section is of a different material, size, and is more configurable. Such design modifications may accommodate different manufacturing capabilities and costs. The chain may be comprised of a metal material, and cap 105 and extension 905 may be comprised of silicone or other material, as discussed above.

Figure 10:
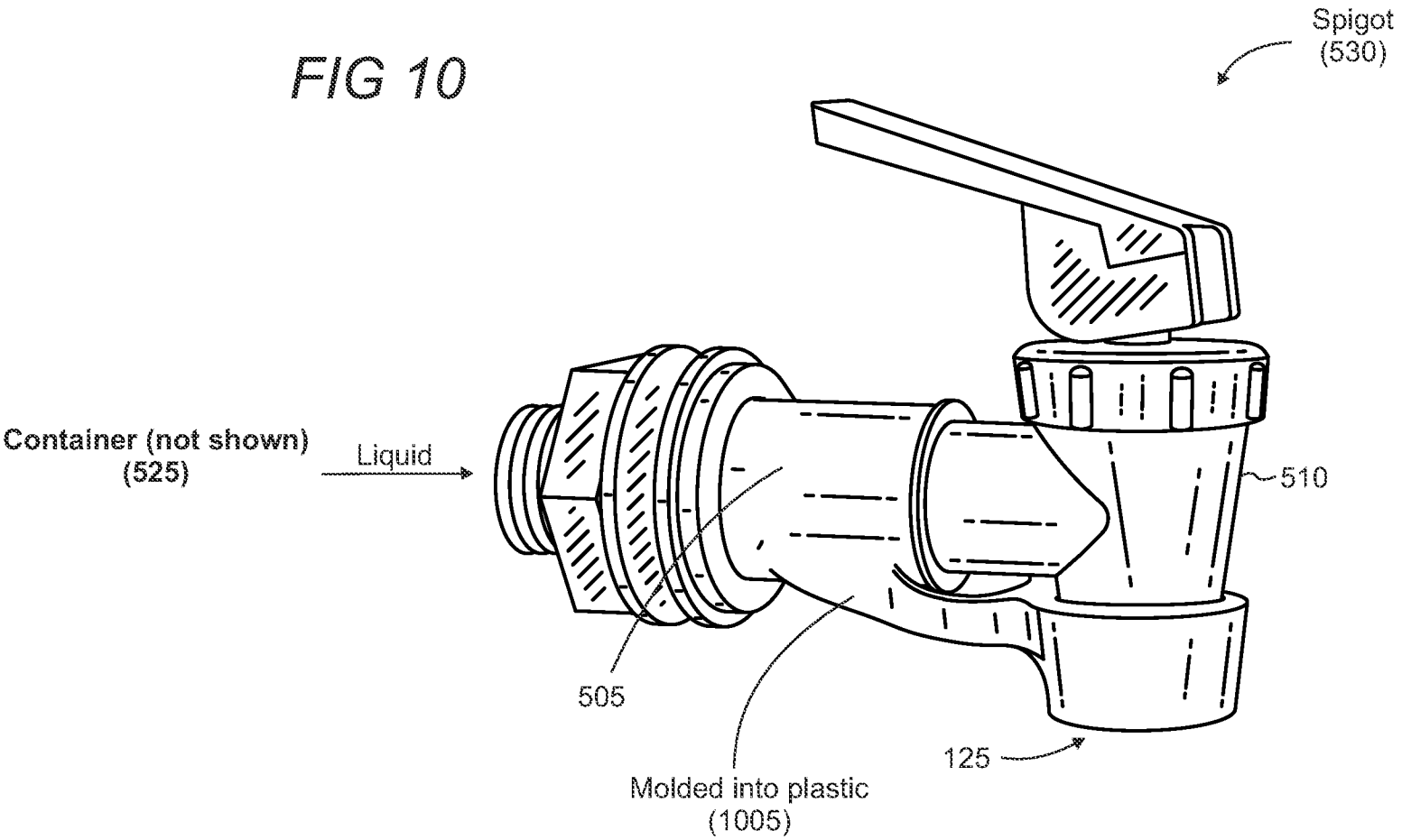
FIG. 10 shows an illustrative representation of the protective cap permanently attached to the spigot.

FIG. 10 shows an illustrative representation of the protective cap 105 according to another embodiment in which the protective cap is directly and permanently connected to the spigot during manufacturing, instead of being an add-on piece. For example, the protective cap's looped section may be made of plastic and molded into the spigot's neck or another component, as representatively shown by numeral 1005. This way, the protective cap is conveniently set in place from the start, and cap 125 can be used and detached from outlet 510 from the start. The entire protective cap may be made from plastic, or the neck may be comprised of plastic and is connected to a silicone cap 125. The cap may alternatively be comprised of plastic on its outside, and the inside may be coated with or otherwise be a silicone insert that enables the press-fit mechanism. The inside silicone may be attached to the plastic, such as using adhesive, or may be an insert piece that is replaceable over time, such as cleaning or replacing after wear and tear.

Although not shown, in another exemplary embodiment, the looped section (i.e., upper and lower loops 110, 115) may be comprised of a clasp mechanism. For example, a tail can extend from the cap, and an end portion of the tail can have an arm that connects to a hole along the tail's body. The tail can wrap around the spigot's stem so that a user can connect the arm of the clasp to one of the holes along the tail and thereby secure the protective cap to the spigot. Various exemplary embodiments are disclosed herein. In one example, a protective cap for protecting a spigot's outlet, comprising: a looped section; and a cap attached to an end of the looped section, wherein the cap includes an opening and a bottom surface at the bottom of the opening.

In another example, the looped section includes an upper loop and a lower loop, the lower loop being proximal to the cap and the upper loop being distal from the cap. As a further example, the lower loop has a smaller diameter than the upper loop, such that the smaller diameter is adapted to press-fit against the spigot's stem. In another example, the upper and lower loops are formed of a single opening in the looped section, and the looped section includes curvatures at the lower loop that creates the smaller diameter relative to the upper loop. As a further example, an incline in the looped section gradually increases toward the exterior of the cap. In another example, the incline begins at a bottom side of the looped section and begins substantially at the beginning of the lower loop. As another example, the cap's opening gradually decreases in diameter toward the bottom surface and is configured to provide a press-fit against a spigot's outlet. In another example, the protective cap is entirely comprised of silicone. In another example, the looped section is permanently attached and connected to a component on the spigot.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A protective cap for protecting a spigot's outlet, comprising:

a looped section; and a cap attached to an end of the looped section, wherein the cap includes an opening and a bottom surface at the bottom of the opening;

wherein the looped section includes an upper loop and a lower loop, the lower loop being proximal to the cap and the upper loop being distal from the cap;

wherein the lower loop has a smaller diameter than the upper loop, such that the smaller diameter is adapted to press-fit against the spigot's stem;

wherein the upper and lower loops are formed of a single opening in the looped section, and the looped section includes curvatures at the lower loop that creates the smaller diameter relative to the upper loop.

2. The protective cap of claim 1, wherein an incline in the looped section gradually increases toward the exterior of the cap.

3. The protective cap of claim 2, wherein the incline begins at a bottom side of the looped section and begins at the beginning of the lower loop.

4. The protective cap of claim 1, wherein the cap's opening gradually decreases in diameter toward the bottom surface and is configured to provide a press-fit against a spigot's outlet.

5. The protective cap of claim 1, wherein the protective cap is entirely comprised of silicone.

* * * * *